US011952023B2

(12) United States Patent
Chen et al.

(10) Patent No.: US 11,952,023 B2
(45) Date of Patent: Apr. 9, 2024

(54) CTC3.0-BASED IMPLEMENTATION METHOD FOR ROUTE HANDLING OF REGIONAL CENTRALIZED CONTROL STATION

(71) Applicant: CASCO SIGNAL LTD., Shanghai (CN)

(72) Inventors: Xuan Chen, Shanghai (CN); Xingli Wang, Shanghai (CN); Huarong Li, Shanghai (CN); Zhenhao Fei, Shanghai (CN); Xiang Wu, Shanghai (CN); Zhenguo Feng, Shanghai (CN); Jiannian Wang, Shanghai (CN); Yahui Cao, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 0 days.

(21) Appl. No.: 17/596,076

(22) PCT Filed: Oct. 19, 2020

(86) PCT No.: PCT/CN2020/121805
§ 371 (c)(1),
(2) Date: Dec. 2, 2021

(87) PCT Pub. No.: WO2021/164285
PCT Pub. Date: Aug. 26, 2021

(65) Prior Publication Data

US 2022/0266884 A1 Aug. 25, 2022

(30) Foreign Application Priority Data

Feb. 18, 2020 (CN) ..... 202010099863.4

(51) Int. Cl.
*B61L 27/04* (2006.01)
*B61L 17/00* (2006.01)
(Continued)

(52) U.S. Cl.
CPC ..... *B61L 27/04* (2013.01); *B61L 17/00* (2013.01); *B61L 17/02* (2013.01); *B61L 23/00* (2013.01);
(Continued)

(58) Field of Classification Search
CPC ..... B61L 23/00; B61L 27/04; B61L 17/00; B61L 17/02; B61L 2027/202; B61L 2027/204
See application file for complete search history.

(56) References Cited

U.S. PATENT DOCUMENTS

2004/0010432 A1* 1/2004 Matheson ..... G06Q 10/06314 706/45

FOREIGN PATENT DOCUMENTS

CN 102267479 A * 12/2011
CN 102267479 A 12/2011
(Continued)

OTHER PUBLICATIONS

Yujie Jia, "TDCS and CTC Railway Signal and Communication Equipment (Second Edition)", dated Feb. 28, 2017, 19 pages (Year: 2017).*
(Continued)

*Primary Examiner* — Zachary L Kuhfuss
*Assistant Examiner* — James William Jones
(74) *Attorney, Agent, or Firm* — HSML P.C.

(57) ABSTRACT

A method for route handling of a regional centralized control station is based on a CTC3.0 technology, and includes the following steps: step (1): generating multi-station train and shunting plans according to a multi-station planning terminal, and executing steps (2) and (4) at the same time; step (2): sending the train plan to an autonomous computer to generate a train route sequence, and executing step (3); step (3): sending, by the autonomous computer, the train route sequence to a regional centralized control route handling terminal; step (4): compiling, by the multi-station planning terminal, an automatically generated shunting route sequence in the shunting plan, and executing step (5); and step (5): synchronizing, by a center service, the shunting route sequence to the regional centralized control route handling terminal.

6 Claims, 1 Drawing Sheet

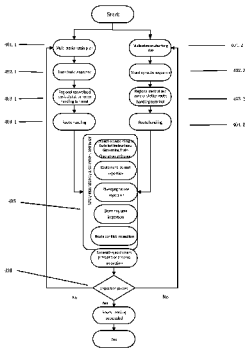

(51) Int. Cl.
*B61L 17/02* (2006.01)
*B61L 23/00* (2006.01)
*B61L 27/20* (2022.01)

(52) U.S. Cl.
CPC ... *B61L 2027/202* (2022.01); *B61L 2027/204* (2022.01)

(56) References Cited

FOREIGN PATENT DOCUMENTS

| | | | | | |
|---|---|---|---|---|---|
| CN | 106553664 | A | * | 4/2017 | ..... B61L 27/0061 |
| CN | 107953903 | A | * | 4/2018 | ..... B61L 27/0038 |
| CN | 108791364 | A | | 11/2018 | |
| CN | 109591857 | A | | 4/2019 | |
| CN | 109677463 | A | * | 4/2019 | ..... B61L 21/00 |
| CN | 109677464 | A | * | 4/2019 | ..... B61L 27/00 |
| CN | 111332341 | A | | 6/2020 | |
| DE | 102004057907 | A1 | | 6/2006 | |
| EP | 3608200 | B1 | * | 9/2021 | ..... B61L 27/00 |
| WO | WO-2019052416 | A1 | * | 3/2019 | ..... B61L 27/04 |

OTHER PUBLICATIONS

Yujie Jia, "TDCS and CTC Railway Signal and Communication Equipment (Second Edition)", dated Feb. 28, 2017, 19 pages, English translation provided.

International Search Report (with English translation) and Written Opinion issued in PCT/CN2020/121805, dated Jan. 18, 2021, 11 pages provided.

* cited by examiner

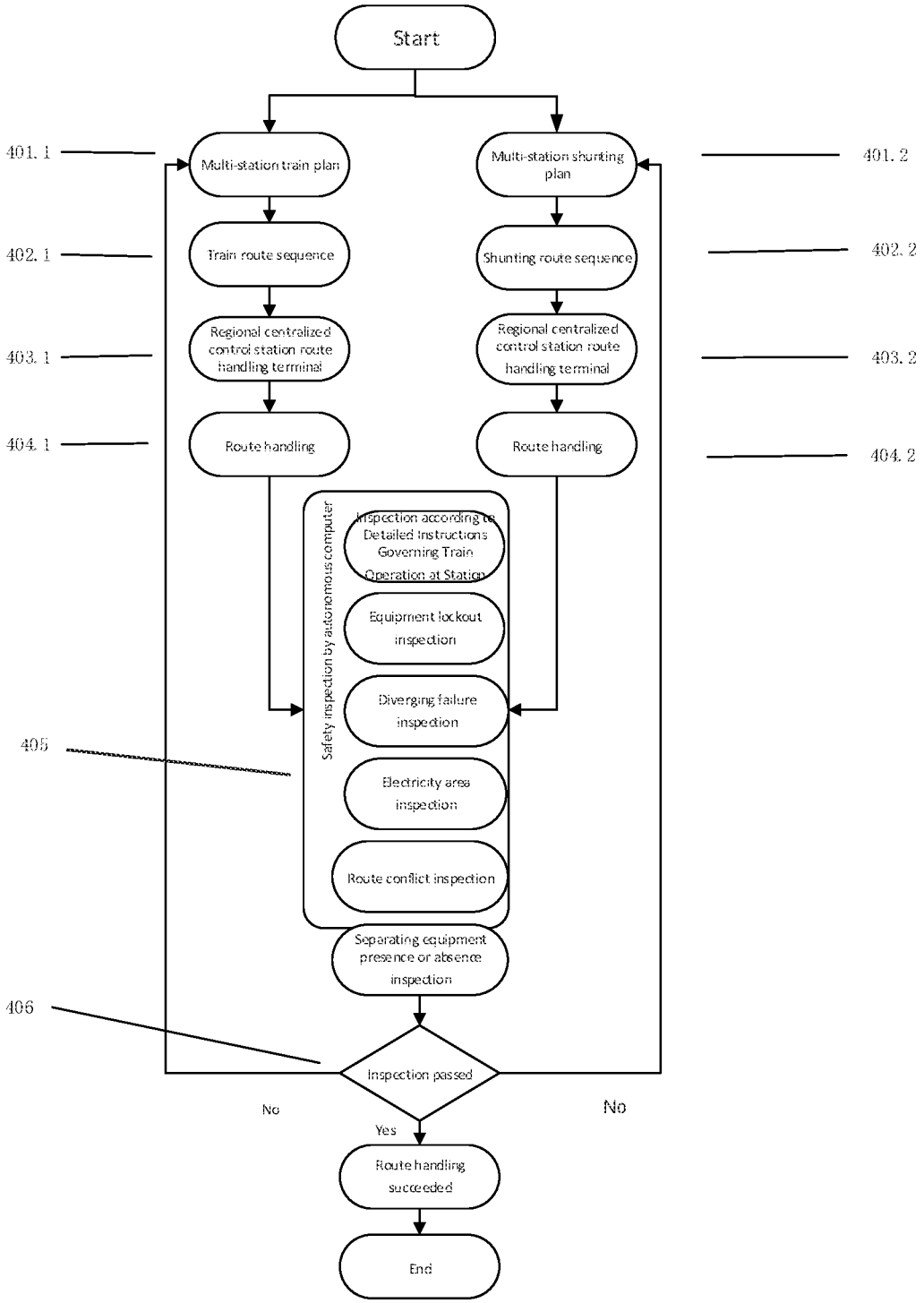
Start
401. 1
Multi-station train plan
Multi-station shunting plan
401. 2
402. 1
Train route sequence
Shunting route sequence
402. 2
403. 1
Regional centralized control station route handling terminal
Regional centralized control station route handling terminal
403. 2
404. 1
Route handling
Route handling
404. 2
405
Safety inspection by autonomous computer
Inspection according to Detailed Instructions Governing Train Operation at Station
Equipment lockout inspection
Diverging failure inspection
Electricity area inspection
Route conflict inspection
Separating equipment presence or absence inspection
406
Inspection passed
No
No
Yes
Route handling succeeded
End

CTC3.0-BASED IMPLEMENTATION METHOD FOR ROUTE HANDLING OF REGIONAL CENTRALIZED CONTROL STATION

TECHNICAL FIELD

The present invention relates to a high-speed train signal control system, and more particularly relates to a CTC3.0-based implementation method for route handling of a regional centralized control station.

BACKGROUND

At present, high-speed railway stations mainly use a center operation mode, most stations have a certain shunting operation amount due to the service characteristics of common-speed railways, a proportion of the common-speed railways using a CTC center operation mode is lower, and two operation modes including station shunting or station control are usually used. At the same time, center operation and station shunting stations will usually delegate powers to lower levels under the conditions of construction, emergency, etc. to convert the operation mode into the station operation mode.

Based on the above CTC usage analysis, a plurality of stations can be concentrated to a regional center according to operation scales of different train service station sections and stations, and the regional center can be arranged at a certain larger station or a certain concentrated office area according to requirements. The regional center is provided with station centralized control consoles, and each of the centralized control consoles is provided with a plurality of attendants according to the workload. Resource waste and low work efficiency are caused. Therefore, how to solve the problem of centralized control console route handling and concentrate multi-station train and shunting operations to the same terminal and the same interface to handle for improving the work efficiency becomes a technical problem to be solved.

SUMMARY

The objective of the present invention is to provide a CTC3.0-based implementation method for route handling of a regional centralized control station with the advantages of wide applications, safety, convenience, and capability of effectively realizing multi-station management of a regional centralized control station for overcoming the defects in the prior art.

The objective of the present invention may be achieved through the following technical solutions:

A CTC3.0-based implementation method for route handling of a regional centralized control station. The method is based on a CTC3.0 technology, and includes the following steps:

step (1): generating multi-station train and shunting plans according to a multi-station planning terminal, and executing steps (2) and (4) at the same time;

step (2): sending the train plan to an autonomous computer to generate a train route sequence, and executing step (3);

step (3): sending, by the autonomous computer, the train route sequence to a regional centralized control route handling terminal;

step (4): compiling, by the multi-station planning terminal, an automatically generated shunting route sequence in the shunting plan, and executing step (5); and step (5): synchronizing, by a center service, the shunting route sequence to the regional centralized control route handling terminal.

Preferably, the train route sequence and the shunting route sequence are displayed in an interface of the regional centralized control route handling terminal.

Preferably, a specific process of displaying, by the regional centralized control route handling terminal, the train route sequence is as follows:

1) according to the multi-station train plan, automatically calculating, by the autonomous computer, a train route to generate the train route sequence;
2) sending, by the autonomous computer, the route sequence to the regional centralized control route handling terminal after the route sequence changes according to an entity of the regional centralized control route handling terminal recorded in a program; and
3) displaying, by the regional centralized control route handling terminal, the train route sequence.

Preferably, the train route sequence is displayed at an upper side of the interface of the regional centralized control route handling terminal.

Preferably, a specific process of displaying, by the regional centralized control route handling terminal, the shunting route sequence is as follows:

1) compiling or receiving, by the multi-station planning terminal, the shunting plan;
2) automatically calculating, by the multi-station planning terminal, a shunting route according to the compiled shunting plan;
3) releasing, by the multi-station planning terminal, the shunting plan to the regional centralized control route handling terminal; and
4) displaying, by the regional centralized control route handling terminal, the shunting route sequence.

Preferably, the shunting route sequence is displayed at a lower side of the interface of the regional centralized control route handling terminal.

Preferably, a route handling state of the regional centralized control route handling terminal is automatically judged by a system, a prompt is sent to a signaler, and finally, a confirmation is made by the signaler.

Preferably, the multi-station train and shunting plans are subjected to a safety inspection by the autonomous computer at background, and an unsafe route failed to pass the inspection is unable to handle.

Preferably, the safety inspection includes an inspection according to Detailed Instructions Governing Train Operation at Station, an equipment lockout inspection, a diverging failure inspection, an electricity area inspection, a route conflict inspection and a separating equipment presence or absence inspection.

Compared with the prior art, the present invention has the following advantages:

1) The problem of centralized control console route handling is solved, multi-station train and shunting operations are concentrated to the same terminal and the same interface to handle, labor resources are saved, and the work efficiency is improved.
2) The application is wide, the present invention is based on the CTC3.0 technology, and can be obtained by upgrading TDCS or CTC. A TDCS system has been popularized in a whole railway network, so that the present invention is almost capable of being used for all lines of the whole railway network.

3) The safety is high. Based on the existing CTC3.0 technology, the multi-station train and shunting operations can be subjected to safety inspections by the autonomous computer at background, and an unsafe route failed to pass the inspection is unable to handle.

BRIEF DESCRIPTION OF THE DRAWINGS

FIG. 1 is a work flow diagram of the present invention.

DETAILED DESCRIPTION OF THE EMBODIMENTS

Clear and complete description will be made to the technical solutions in embodiments of the present invention in conjunction with drawings in the embodiments of the present invention hereafter. Obviously, the described embodiments are merely a part of embodiments of the present invention and not all the embodiments. Based on the embodiments of the present invention, all of other embodiments obtained by a person of ordinary skill in the art without any creative effort shall belongs to the protection scope of the present invention.

The present invention solves the problem of centralized control console route handling, multi-station train and shunting operations are concentrated to the same terminal and the same interface to handle, labor resources are saved, the work efficiency is improved.

A CTC3.0-based implementation method for route handling of a regional centralized control station of the present invention includes the following steps:

(1) Multi-station train and shunting plans are generated according to a multi-station planning terminal.

(2) The train plan is sent to an autonomous computer to generate a train route sequence.

(3) The train route sequence is sent to a regional centralized control route handling terminal by the autonomous computer.

(4) The multi-station planning terminal compiles an automatically generated shunting route in the shunting plan.

(5) The shunting route is synchronized to the regional centralized control route handling terminal by a center service.

The train route sequence and the shunting route sequence are displayed in the same interface of the regional centralized control route handling terminal.

A specific process of displaying the train route sequence by the regional centralized control route handling terminal is as follows:

1) According to the multi-station train plan, the autonomous computer automatically calculates a train route to generate the train route sequence.

2) The autonomous computer sends the route sequence to the regional centralized control route handling terminal after the route sequence changes according to an entity of the regional centralized control route handling terminal recorded in a program.

3) The train route sequence is displayed at an upper side of the interface of the regional centralized control route handling terminal.

A specific process of displaying the shunting route sequence by the regional centralized control route handling terminal is as follows:

1) The multi-station planning terminal compiles or receives the shunting plan.

2) The multi-station planning terminal automatically calculates a shunting route according to the compiled shunting plan.

3) The multi-station planning terminal releases the shunting plan to the regional centralized control route handling terminal.

4) The shunting route sequence is displayed at a lower side of the interface of the regional centralized control route handling terminal.

A route handling state of the regional centralized control route handling terminal is automatically judged by a system, a prompt is sent to a signaler, and finally, a confirmation is made by the signaler.

As shown in FIG. 1, a specific method of the present invention is as follows:

Steps 401.1, 401.2, a train plan is released by a center dispatching console and is obtained by a multi-station planning terminal.

Step 402.1, the planning terminal sends the train plan to an autonomous computer to generate a train route sequence.

Step 402.2, a shunting operator of a current station compiles a shunting plan, and a shunting route is automatically generated.

Step 403.1, the train route sequence is sent to a regional centralized control route handling terminal by the autonomous computer.

Step 403.2, the multi-station planning terminal compiles an automatically generated shunting route in the shunting plan, and the shunting route is synchronized to the regional centralized control route handling terminal by a center service.

Steps 404.1, 404.2, the route handling terminal handles the route.

Step 405, the autonomous computer performs safety logic inspection.

Step 406, if the inspection is passed, a result is sent to interlocking to handle the route; and if the inspection is failed, the route handling is refused.

The safety logic inspection includes an inspection according to Detailed Instructions Governing Train Operation at Station, an equipment lockout inspection, diverging failure inspection, an electricity area inspection, a route conflict inspection and a separating equipment presence or absence inspection.

The above descriptions are only specific implementations of the present invention. However, the protection scope of the present invention is not limited thereto, any person skilled in the art can easily think of various equivalent modifications or substitutions within the technical scope disclosed by the present invention, and all of these modifications or substitutions shall fall within the protection scope of the present invention. Therefore, the protection scope of the present invention should be determined with reference to the appended claims.

The invention claimed is:

1. A CTC3.0-based implementation method for route handling of a regional centralized control station, the method being based on a CTC3.0 technology, and comprising the following steps:

step (1): generating a multi-station train plan and a multi-station shunting plan according to a multi-station planning terminal, and executing steps (2) and (4) at the same time;

step (2): sending the train plan to an autonomous computer to generate a train route sequence, and executing step (3);

step (3): sending, by the autonomous computer, the train route sequence to a regional centralized control route handling terminal;

step (4): compiling, by the multi-station planning terminal, an automatically generated shunting route sequence in the shunting plan, and executing step (5); and step (5): synchronizing, by a center service, the shunting route sequence to the regional centralized control route handling terminal, wherein the train route sequence and the shunting sequence are generated at the same time and handled by the same regional centralized control route handling terminal to be displayed in a same interface of the same regional centralized control route handling terminal, wherein a specific process of displaying, by the same interface of the same regional centralized control route handling terminal, the train route sequence is as follows:

1) according to the multi-station train plan, automatically calculating, by the autonomous computer, the train route to generate the train route sequence;

2) sending, by the autonomous computer, the train route sequence to the regional centralized control route handling terminal after the train route sequence changes according to a record of the regional centralized control route handling terminal; and 3) displaying, by the regional centralized control route handling terminal, the train route sequence, and wherein a specific process of displaying, by the same interface of the same regional centralized control route handling terminal, the shunting route sequence is as follows:

1) compiling or receiving, by the multi-station planning terminal, the shunting plan;

2) automatically calculating, by the multi-station planning terminal, the shunting route sequence according to the compiled shunting plan;

3) releasing, by the multi-station planning terminal, the shunting plan to the regional centralized control route handling terminal; and 4) displaying, by the regional centralized control route handling terminal, the shunting route sequence.

2. The CTC3.0-based implementation method for route handling of the regional centralized control station according to claim 1, wherein the train route sequence is displayed at an upper side of the interface of the regional centralized control route handling terminal.

3. The CTC3.0-based implementation method for route handling of the regional centralized control station according to claim 1, wherein the shunting route sequence is displayed at a lower side of the interface of the regional centralized control route handling terminal.

4. The CTC3.0-based implementation method for route handling of the regional centralized control station according to claim 1, wherein a state of the regional centralized control route handling terminal to handle the train route sequence and the shunting_route sequence is automatically judged by a system, a prompt is sent to a signaler, and finally, a confirmation is made by the signaler.

5. The CTC3.0-based implementation method for route handling of the regional centralized control station according to claim 1, wherein the multi-station train and shunting plans are subjected to a safety inspection by the autonomous computer at a background, and an unsafe route failed to pass the inspection is unable to handle.

6. The CTC3.0-based implementation method for route handling of the regional centralized control station according to claim 5, wherein the safety inspection comprises an equipment lockout inspection, a diverging failure inspection, an electricity area inspection, a route conflict inspection and a separating equipment presence or absence inspection.

* * * * *